US006796525B2

(12) United States Patent
Johnsson et al.

(10) Patent No.: US 6,796,525 B2
(45) Date of Patent: Sep. 28, 2004

(54) FIN-STABILIZED GUIDABLE MISSILE

(75) Inventors: Stig Johnsson, Karlskoga (SE); Ulf Hellman, Ornskoldsvik (SE); Ulf Holmqvist, Karlskoga (SE)

(73) Assignee: Bofors Defence AB (SE)

( * ) Notice: Subject to any disclaimer, the term of this patent is extended or adjusted under 35 U.S.C. 154(b) by 0 days.

(21) Appl. No.: 10/312,978

(22) PCT Filed: Jun. 13, 2001

(86) PCT No.: PCT/SE01/01333

§ 371 (c)(1),
(2), (4) Date: Jul. 11, 2003

(87) PCT Pub. No.: WO02/06761

PCT Pub. Date: Jan. 24, 2002

(65) Prior Publication Data

US 2004/0011920 A1 Jan. 22, 2004

(30) Foreign Application Priority Data

Jul. 3, 2000 (SE) ..... 0002480

(51) Int. Cl.[7] ..... F42B 10/14

(52) U.S. Cl. ..... 244/3.28; 244/3.29; 244/3.27; 102/476

(58) Field of Search ..... 244/3.23, 3.24, 244/3.25, 3.26, 3.27, 3.28, 3.29, 3.3; 102/476

(56) References Cited

U.S. PATENT DOCUMENTS 2,611,317 A * 9/1952 Africano ..... 244/3.23
2,981,188 A * 4/1961 Lipinski et al. ..... 102/476
3,764,091 A * 10/1973 Crowhurst ..... 244/3.22
3,970,004 A * 7/1976 Suter ..... 102/476
4,373,688 A * 2/1983 Topliffe ..... 244/3.24
4,690,350 A * 9/1987 Grosso et al. ..... 244/3.1
4,752,052 A 6/1988 Galvin
6,126,109 A * 10/2000 Barson et al. ..... 244/3.28
6,474,594 B1 * 11/2002 Johnson et al. ..... 244/3.24
6,640,720 B1 * 11/2003 Biserød ..... 102/377

FOREIGN PATENT DOCUMENTS

GB 2265443 A 9/1993
JP 02050097 A * 2/1990 ..... F24B/10/64

* cited by examiner

*Primary Examiner*—Michael J. Carone
*Assistant Examiner*—Gabriel S Sukman
(74) *Attorney, Agent, or Firm*—Connolly Bove Lodge & Hutz LLP

(57) ABSTRACT

The present invention relates to a fin-stabilized missile (1) of the type which is intended to be fired at high acceleration towards a defined target along its trajectory and which can be guided in the trajectory and which, for stabilizing it in the trajectory, is provided with stabilizing fins (3, 32) arranged at its rear end, and control elements (6, 7) which are arranged at its front end and are intended to guide the latter, and whose rear part, in which the fins are secured, consists of a body part (4, 31) which can rotate freely relative to the main part (1, 29) of the missile about a bearing (14, 36) arranged concentric to the longitudinal axis (L) of the missile (1). According to the invention, said bearing (14, 36) is arranged near the dividing plane between the missile (1) and the body part (4, 31) and has a short length in the longitudinal direction of the missile, this having been made possible by the fact that it has been given a large diameter compared with its length and it has been designed with special load-bearing contact surfaces (20, 21, 27, 28) which limit the stresses during ramming and firing and during the flight of the missile (1) through the air. The freely rotatable body part (4, 31) for the fins (32) can then in turn be axially displaced from a launch position located inside the missile to a flight position where the fins (32) are pushed out behind the rear plane of the missile, where they can rotate freely.

20 Claims, 5 Drawing Sheets

FIN-STABILIZED GUIDABLE MISSILE

Figure 1:
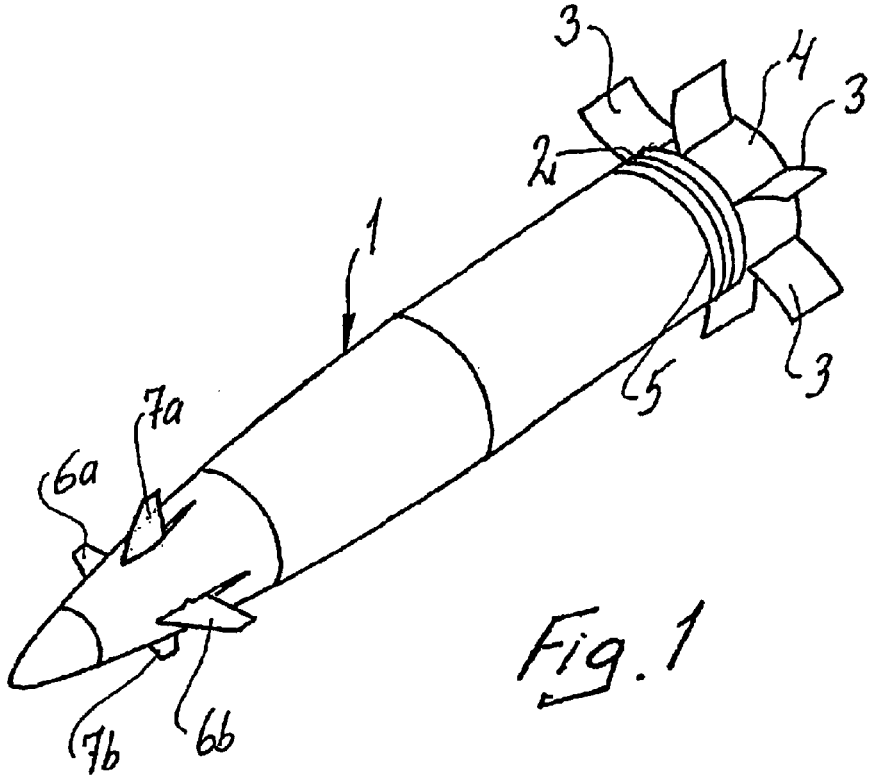

The present invention relates to a novel type of fin-stabilized missiles which can be guided in their respective trajectories towards a predetermined target. Guidable missiles here signify guidable artillery shells, rockets or projectiles. These are assumed here to be of the general type which are preferably fired without rotation, or at a low inherent rotation about their longitudinal axis, and which, for stabilizing them in their trajectory towards the target, are assumed to be provided with stabilizing fins which are arranged at the rear end and are initially retracted until the missile has completely exited the launch arrangement from which it has been fired, and can then be deployed once it has left the launch arrangement completely. To guide the missiles in pitch and yaw in their trajectories towards their intended targets, they are also assumed to be provided with control members arranged for this purpose preferably at their front end.

In many cases it is desirable, as it is in the present invention, to be able to guide missiles (for example shells, rockets or projectiles) towards a defined target while the missiles are in their trajectory. This can be done, for example, by guiding them in pitch and yaw by means of control members arranged at the front end of the missile, and these members can consist for example of canard fins, jet nozzles, etc.

Airborne missiles can be rotation-stabilized in their trajectory or stabilized in another way, for example by means of fins. Rotation-stabilized missiles have steady trajectories and they can be made mechanically simple since the launch arrangement as a rule is responsible for ensuring that the missile acquires the necessary initial rotation. However, the high rotational velocity has at least hitherto made it impossible to provide this type of missile with a well-functioning guidance system. When work is undertaken today to develop effective guidable missiles, one has therefore concentrated efforts on missiles which do not rotate at all, or rotate only slowly, about their own longitudinal axis and which are aerodynamically stabilized by means of fins arranged in their rear part.

In addition to stabilizing the missile flight, the stabilizing fins, in a fin-stabilized nonrotating missile, or in a missile rotating only slowly, can additionally give rise to an active lifting force which acts on the missile and can be used to increase its range of fire.

A current trend in the development of artillery technology is towards new long-range artillery missiles guided in their final phase, and interest has increased in different types of fin-stabilized shells intended for firing in conventional guns and howitzers. To make it possible to launch fin-stabilized shells with a low inherent rotation directly from grooved barrels, the shells need to be provided with a drive band as their only direct contact with the grooving of the barrel. The same gun or howitzer can thus be used, without special intermediate measures, to successively fire essentially nonrotating shells provided with drive bands and with stabilizing fins, which can be deployed in trajectory, and entirely conventional rotation-stabilized shells.

In controlling the trajectory of fin-stabilized missiles such as shells, rockets and projectiles, it is necessary to know and be able to control the roll position of the missile. This in order to be able to control the missile in pitch and yaw. This control is achieved preferably with special control elements, for example in the form of movable nose fins, called canard fins, or jet nozzles. However, the roll control moment which such control elements in the front part of the missile give rise to can in many cases be counteracted or completely eliminated by the guide fins in the rear part of the missile, unless special measures are taken. This is due to the fact that the vortices caused by the control moment from the rudder or other control activity impact the fins and this in turn gives rise to a counteracting moment.

A way of solving this problem which has already been tested to an at least limited extent is to let the part of the missile in which the fins are secured constitute a unit which can rotate freely in relation to the rest of the missile about an axis concentric with the longitudinal axis of the missile. In this way, the effect of the control moment on the fins cannot be transferred to the front part of the missile, as a result of which the missile is made easier to control.

From a purely practical point of view, it might be considered very easy to design a freely rotating bearing between the main part of the missile and a fin unit connected to the latter, but in reality this is not such a straightforward matter—indeed it is extremely complicated—since all the parts of the bearing have to be dimensioned in a way which takes into account the stresses in the form of high acceleration and deceleration which these parts have to tolerate both during ramming and during launch, and the maximum forces which occur in these cases are also effected in different directions.

The basic principle of the freely rotating fin unit has therefore to be regarded as already known at least in terms of its main features. The present invention therefore relates more specifically to a missile provided with a specially designed freely rotating fin unit. The invention is also in the first instance intended to be applied to a fin-stabilized artillery shell, but it can also apply to any other fin-stabilized and slowly rotating missile of the abovementioned general type. The particular characteristic feature of the fin-stabilized missile according to the invention is thus the design of the bearing for the freely rotating fin unit. This bearing has now been designed to tolerate the acceleration and deceleration forces during ramming of the shell and then the acceleration forces during firing of the shell.

The fin stabilizing unit forming part of the shell according to the invention thus comprises a specific body part in which the fins are secured and relative to which the fins can be retracted, and this body part can in turn rotate freely relative to the rest of the shell about a bearing which is concentric to the longitudinal axis of the shell. This bearing in turn comprises a ball bearing or roller bearing in a single bearing position with the greatest possible bearing diameter but with a very short length in the direction of flight of the missile, compared to said diameter, and this bearing position is additionally preferably arranged as close as possible to the dividing plane, running transverse to the longitudinal direction of the missile, between the rest of the missile and the fin stabilizing unit which rotates freely relative to the latter. The bearing which characterizes the invention moreover comprises specially designed pairs of interacting contact surfaces in both the main part of the shell and in the body part, arranged peripherally with respect to the freely rotating fin unit and activated in the axial direction upon maximum acceleration and deceleration stresses. In the preferred embodiment of the invention, these contact surfaces are designed in such a way that the acceleration and deceleration contact surfaces belonging to either the freely rotating body part or the main part of the missile are oriented in opposite directions, which means that the contact surfaces in the body part are directed towards each other while those in the main part of the missile are directed away from each other. In a development of the invention, there is also a specifically designed spring system whose task it is to take up within certain limits those forces which act in the longitudinal direction of the shell between the rest of the missile and the body part of the fin unit and which act on these parts to move them away from each other. This spring system, which acts between one of the parts and one of the drive rings of the ball bearing, has the task of allowing the parts to rotate freely relative to each other even when they are stressed away from each other by a limited force, as will be the case when the missile is flying through the air with the fins deployed. At the same time the spring has a safety function in that it is intended to ensure that the abovementioned contact surfaces engage with each other before there is any risk of exceeding the maximum bearing load which the ball bearing tolerates. As soon as said maximum bearing load approaches, the counter effect of the spring will have been exceeded and the parts will have been fixed relative to each other by means of the contact surfaces having engaged with each other and the free mutual rotation having ceased. As soon as the excessive loading has ceased, the spring will then ensure that the parts return to their original positions and the free mutual rotation again becomes possible.

The invention also includes a specific development in which the points of attachment of the fins consist of an axially displaceable body part which from a first retracted position inside the rear end of the missile body in front of its usual rear plane can be pushed out to a second deployed position where the fins and their points of attachment are situated behind said rear plane and where the fins are free to unfold and where this body part at least in its pushed-out position can rotate freely relative to the rest of the missile. Said body part can be designed as a cylinder which in the original position is thus inserted in a cylindrical cavity in the rear part of the missile. The detailed design of the body part can then vary depending on which fin type is chosen. With fins of the wrap-around type or folding-fin type, which are arranged along the outer periphery of the body part and are initially folded in towards the latter, the body part can provide space for a base-bleed unit, while in other types of fins, for example those which in the retracted position are folded into axial tracks in the body part about axles transverse to the longitudinal axis, the base-bleed unit has to be divided up into a number of smaller parts, which in turn will mean that there is less space available for the base-bleed powder. With the body part inserted into the rear part of the missile, there are less stresses, when the missile is a shell, in particular on the bearing during ramming in the barrel of the artillery piece since the drive band of the shell can then be arranged on that part of the missile in which the body part is inserted in the original position.

To ensure that the system with an axially displaceable body part can at the same time give a freely rotatable fin part, the body part must comprise a first body section and a second body section, where the first body section is axially displaceable, but not rotatably connected to the rest of the missile, while the second body section is displaceable together with the first one and freely rotatable relative to it. When the body part is displaced between its two positions, these two sections are thus displaced axially to a position where the second body section lies completely outside the original rear plane of the missile and in this position the displacement of the first body section is locked for example by means of an abutment flange or other type of deformation lock between the parts.

To activate the pushing-out of the fin-supporting body part from its position inside the rear end of the missile to its extended position, different methods can be used, for example in the form of expanding pyrotechnic gases. In a method which is particularly well suited to artillery shells, during the actual launch some of the powder gases from the propellant charge of the firing equipment are introduced via a narrow channel into a chamber between the push-out body part and the rest of the missile, and after the missile has left the barrel and the powder gas pressure behind the missile has ceased, the expansion of these powder gases is used to drive the body part out to its outer position. The same method can also be used to remove a protective casing which during launch protects an axially immovable fin unit and which has to be removed before the fins can be deployed. This method, which has the advantages that it provides an extremely rapid reaction associated completely with the passage of the missile from the barrel muzzle, and that it is entirely without any need for extra components, is also described in more detail in connection with the examples below.

Figure 2:
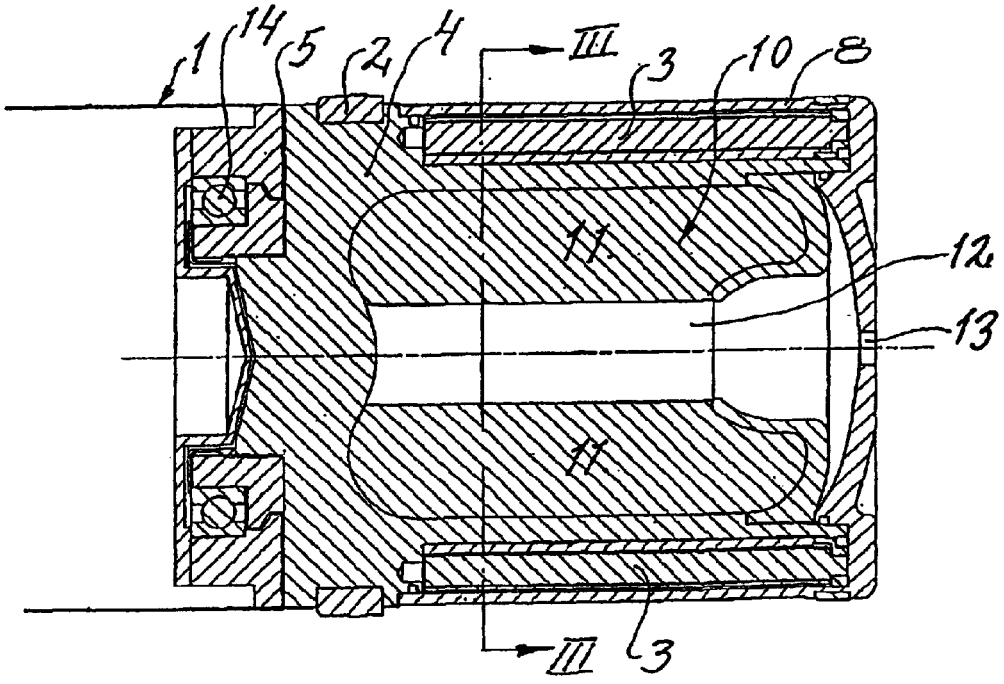
Figure 3:
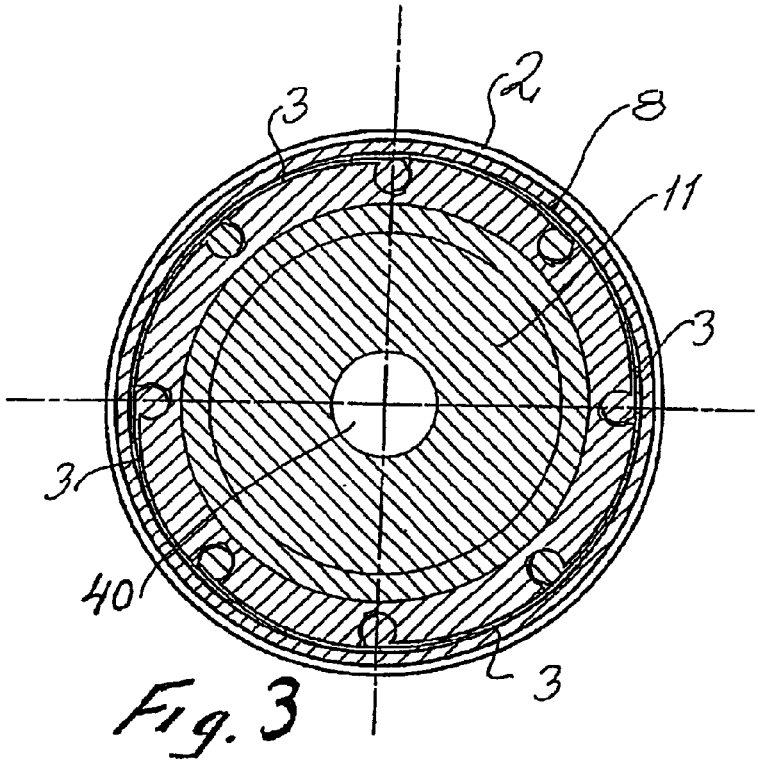
Figure 4:
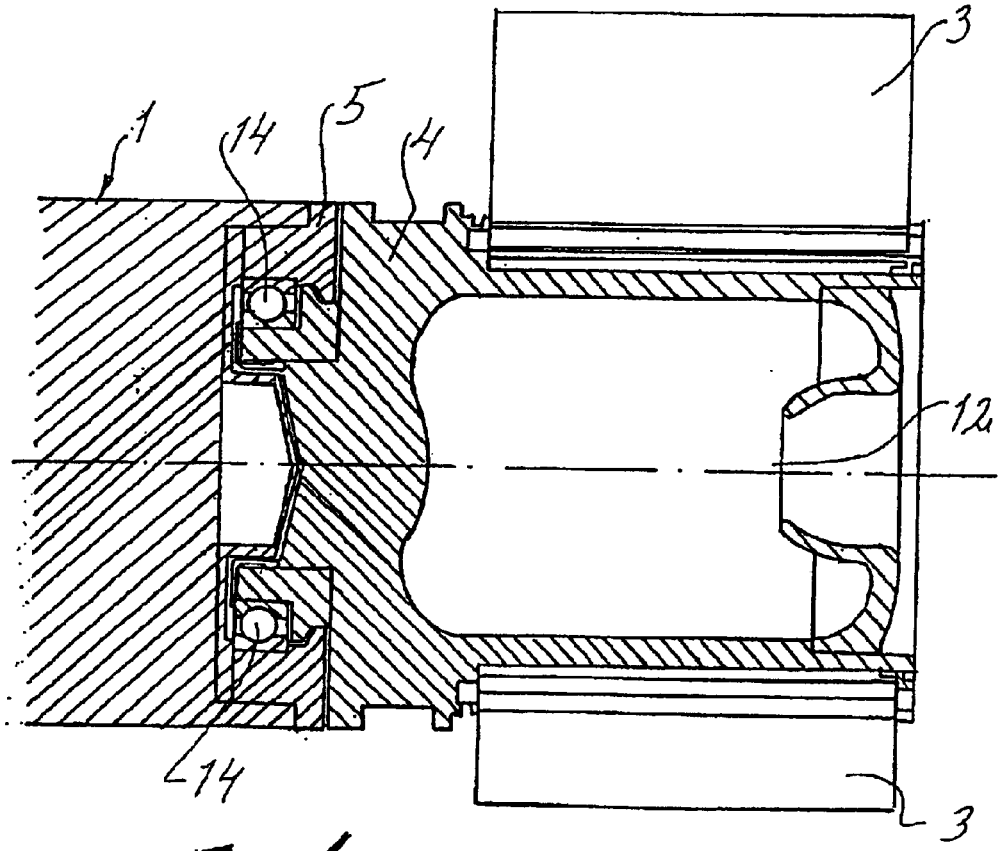
Figure 5:
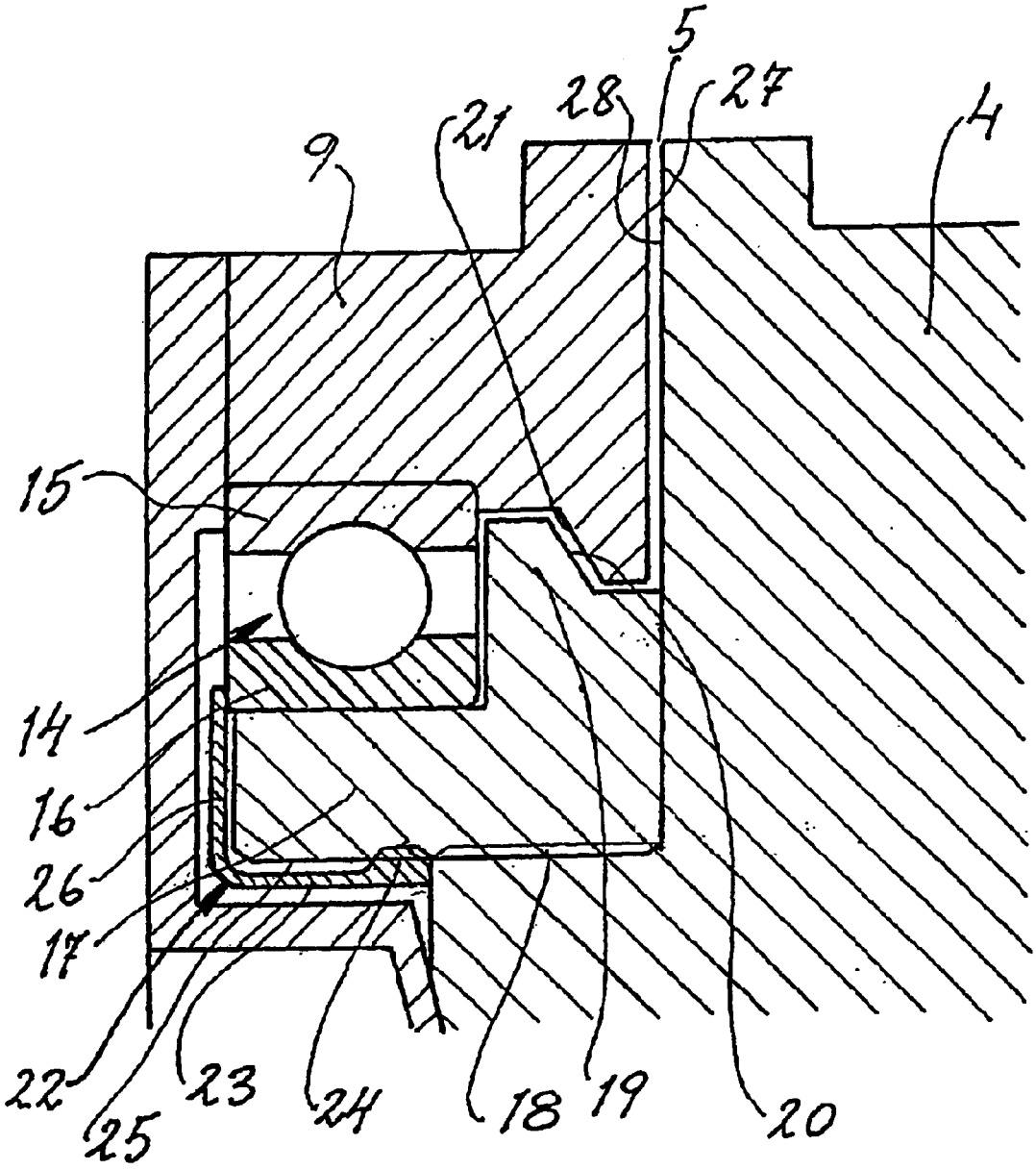
Figure 6:
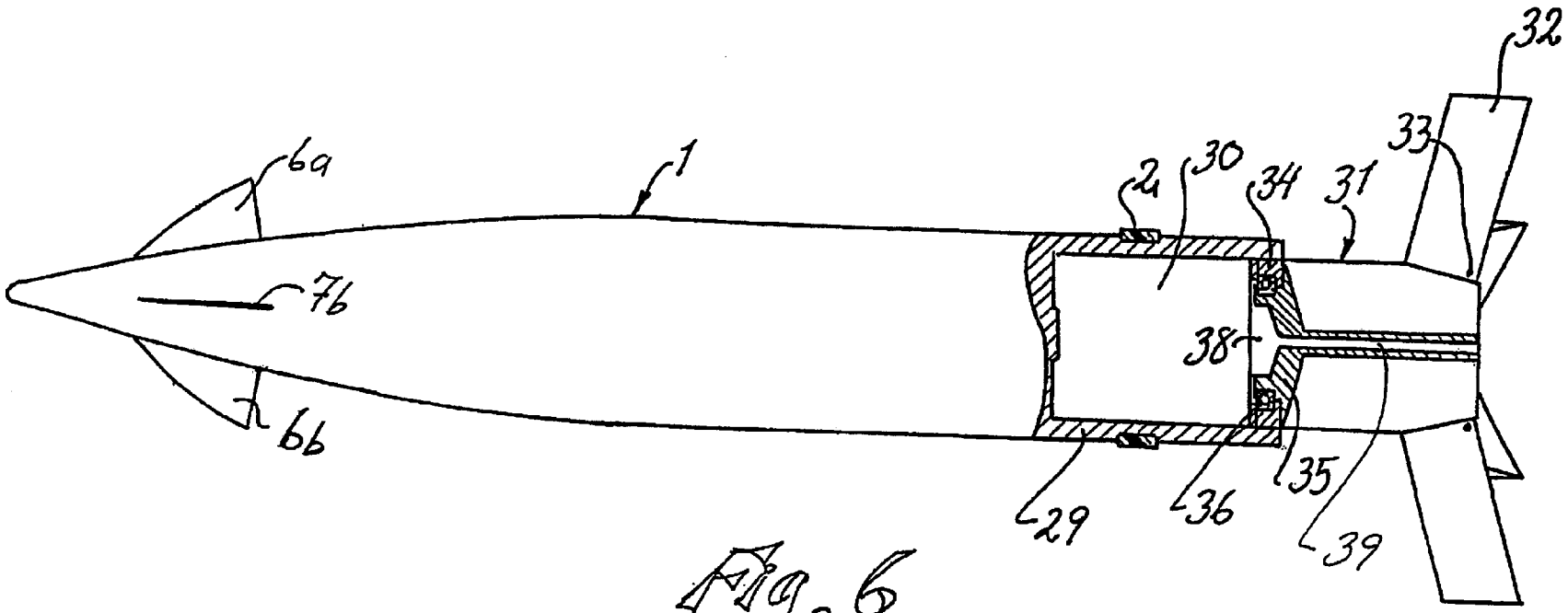
Figure 7:
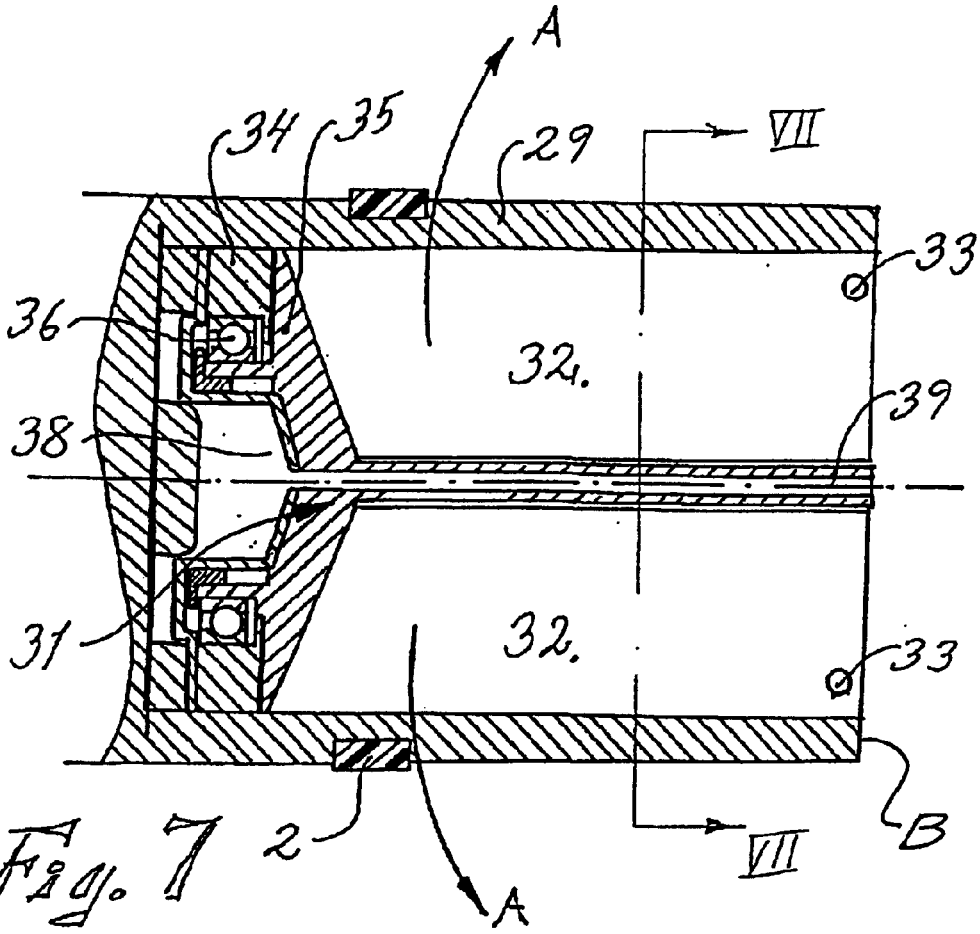
Figure 8:
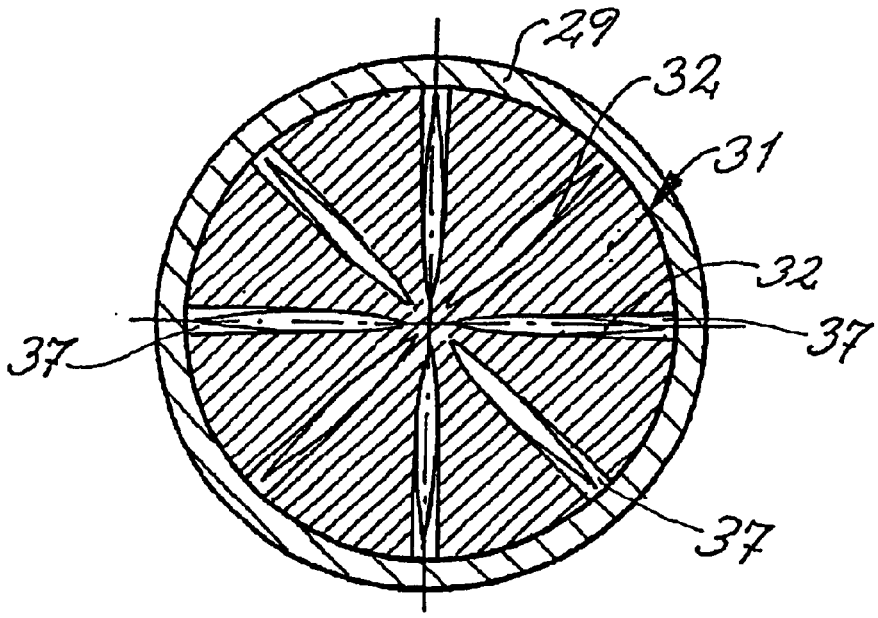

The invention has been defined in its entirety in the attached patent claims and it will now be described in some detail with reference to the attached figures, of which:

FIG. 1 shows a shell according to the invention on its way towards its target, FIG. 2 shows in longitudinal section the rear part of the same shell as in FIG. 1, before being launched, FIG. 3 shows the cross section along III—III in FIG. 2, FIG. 4 shows the same details as in FIG. 2, but after launch, and with the fins deployed, FIG. 5 shows the circled part from FIG. 4 on a larger scale, FIG. 6 shows a partial cross section through a missile with a fin unit which is displaceable in the longitudinal direction, FIG. 7 shows the fin unit according to FIG. 6 in the retracted position, and FIG. 8 shows the cross section VII—VII from FIG. 7.

The missile shown in FIG. 1, in this case the shell 1, is provided with a band track 2 for a drive band (this is generally lost when the shell leaves the barrel), a number of deployable fins 3 which are shown fully deployed in the figure and which are fixed on a body part 4 which rotates freely relative to the rest of the shell about an axis concentric with the longitudinal axis of the shell. The dividing plane between the shell 1 and the body part has been labelled 5. In addition, the shell 1 has two pairs of controllable canard fins 6*a*, 6*b* and 7*a*, 7*b* arranged on a respective quadrant axis and with which the course and trajectory of the shell can be corrected in accordance with control commands received either from an internal target seeker or from the launch site, via satellite, radar or other means. The way in which the shell receives control commands has nothing to do with the invention. This question will not therefore be mentioned again below.

FIGS. 2, 3 and 4 show in greater detail how the body part 4 is constructed. Also included here are reference labels 2 for the band and 5 for the dividing plane between the body part and the rest of the shell. As will be seen from the figures, the drive band of the shell in this variant is placed on the body part 4 of the fin unit. This is because it is advantageous to have the drive band placed far back on a shell. The above-mentioned dividing plane 5 will be returned to in connection with FIG. 5. The fins 3 are shown in FIGS. 2 and 3 in the retracted position (see also FIGS. 4 and 5) in which they are covered by a removable casing 8. In the case shown in FIGS. 2 and 3, the casing covers the fins and also a base-bleed unit 10 which is arranged in the centre of the body part and whose charge of slow-burning powder here has the label 11 and its gas outlet has the label 12. As will be seen from FIG.

3, the fins 3 in the retracted position are incurved towards the inside of the casing 8. In the casing 8 there is also a relatively narrow gas inlet 13 which upon launch of the shells gives the barrel pressure, i.e. the powder gases from the propellant powder charge, free access to that part of the inside 40 of the base-bleed unit which is not taken up by its powder charge 11. At the same time the inlet and outlet 13 in the casing 8 is so designed that when the shell leaves the barrel and the pressure surrounding the shell quickly drops to atmospheric pressure, the gas expansion reaches inside the casing by means of the fact that the inlet and outlet 13 is so designed that the gases do not get out quickly enough, resulting in the casing being removed and the fins being released and deployed. This position is shown in FIG. 4. As will further be seen from the figures, the body part 4 is joined to the rest of the shell via a ball bearing 14 whose outer ring 15 is securely connected to an annular component 9 which is fixed relative to the rest of the shell. Since the drive band 2 of the shell in the variant shown in FIGS. 2–5 is mounted on the body part 4 of the fin unit, this body part 4 is drawn off from the main part of the shell 1 when rammed into the launch equipment with great force (it must be anticipated that in future all ramming will be done by mechanical rammers), while the body part 4, during launch, is instead pressed towards the main part of the shell 1 with a preferably even greater force. Both these forces would certainly damage the bearing 14 if not taken up, and this is therefore one of the aims of this invention.

To relieve the loading on the ball bearing 14 whose outer ring 15 is thus securely connected to the main part of the shell 1, the inner ring 16 of the bearing is mounted on a bearing support 17 in such a way that the ring can easily slide axially. The bearing support 17 is in turn securely connected to the body part 4 of the fin unit, for example by means of a threaded connection 18. The bearing support 17 is further designed with a force-transmitting unit 19 which in the example shown has a contact surface 20 frustoconical about its periphery and directed away from the main part of the shell, which contact surface 20 faces across a predetermined clearance to a correspondingly designed contact surface 21 securely connected to the main part of the shell. These two contact surfaces—the one labelled 20 in the fin unit being directed rearwards in the direction of flight of the shell, and the one labelled 21 in the main part of the shell being directed forwards in the direction of flight of the shell—now define, as they are brought together, the maximum distance by which the main part of the shell and the fin unit can be displaced in the direction away from each other.

However, the arrangement according to the invention also includes two opposing contact surfaces intended to limit the loading on the bearing 14 when the main part of the shell 1 and the body part 4 of the fin unit are pressed towards each other. These two contact surfaces 27 and 28 lie in the dividing plane 5.

When the shell is rammed into the equipment from which it is to be fired, the fin unit is drawn rearwards relative to the rest of the missile, when the missile brakes upon ramming, since the body part of the fin unit comprises the drive band 2 which, during ramming, is pressed securely in the ramming position, while the main part of the missile has the greatest mass and a high velocity. In this position, the distance between the contact surfaces 20 and 21 will disappear and the contact surfaces will transmit all the loading between themselves. This is made possible by the fact that the bearing support and the inner ring 16 of the bearing 14 are displaced relative to each other.

To permit a limited displacement of the main part of the shell 1 and the fin part (the body part 4) away from each other, but with a continuously functioning ball bearing 14, the arrangement according to the invention has been supplemented, in a particularly preferred embodiment, with a spring unit 22 in the form of a specially designed annular spring or tubular spring with an L-shaped cross section and with a first tubular part 23 via which it is connected by an internal thread 24 to the cylindrical outside 25 of the bearing support 17, and a second resilient plane annular limb 26 whose inner edge lies against the inner ring 16 of the ball bearing 14 and there counteracts a displacement of the main part of the shell 1 and the fin unit (the body part 4) away from each other. As long as this spring unit 22 is tensioned but has not yet reached the bottom position of the displacement possibility, the fin unit will thus be able to rotate freely via the ball bearing 14. The possibility of rotation with a tensioned spring unit will apply in particular when the shell is flying through the air and the air flowing past acts on the fins 3. In this position, the spring unit will be tensioned but only so much that the bearing 14 still functions. If the load which the spring unit tolerates is exceeded, then the contact surfaces 20 and 21 come together and the possibility of rotation ceases, but at the same time the ball bearing is relieved of increased loading.

Instead, the fin unit is pressed towards the main part of the shell during launch, and the contact surfaces 27 and 28 engage with each other. The ball bearing 14 at the same time slides on the bearing support until its force-transmitting unit 19 comes to support the inner ring 16 of the bearing. The distance between the contact surfaces 27 and 28 and between the inner ring 16 and the force-transmitting unit 19 of the bearing support is almost identical. The tolerances must be such that the difference is less than the axial play in the bearing 14.

The shell illustrated in FIGS. 6, 7 and 8 can still have its main part labelled 1 and it is provided in its rear part, here labelled 29, with a drive band 2. A cavity 30 is arranged in the rear part 29 of the shell. A specially configured fin body 33 is arranged inside this cavity until the shell has left the artillery piece in which it is fired. The fin body with its retracted fins is shown in the retracted position in FIGS. 7 and 8. There are eight fins here and they are all labelled 32. Each one of them lies in its own track 37 in the body part 31 and they can be deployed outwards and rearwards about their axes 33, in the manner indicated by the arrows A in FIG. 7. The special feature of the variant of the invention shown in these figures is that the fin body 31 here consists of a front section 34 and a rear section 35 which are rotatable relative to each other with a ball bearing 36 between them corresponding to the type in the previously described variant of the invention. However, because of the position of the drive band 2, the system for relieving the forces on the bearing 36 can be made slightly simpler than in the previous variant.

The special feature of this variant of the invention is that when the shell has left the artillery piece from which it is fired the whole of the fin body 31 is displaced from its fully retracted position in the space 30 to a position where only its front section 34 is left in its outlet, where it is blocked by means of a deformation joint of one type or another, while the whole of the rear part 35 of the fin body is located behind the original rear plane B of the shell and where the fins 32 are deployed in the manner indicated in FIG. 7 and the rear part of the body in which they are secured is allowed to rotate freely relative to the main part of the shell about the bearing 36 concentric with the longitudinal axis of the shell. For pushing the body part 31 out to its rear position, the propellant powder gases are used which as previously described, are allowed during launch, to flow via the channel 39 into the inner chamber which is labelled 38.

An advantage of this variant is that the fins reach further away from the centre of gravity of the missile and in this way the fins can be made smaller while retaining the stability of the missile.

What is claimed is:

1. Fin-stabilized missile (1) which is intended to be fired at high acceleration towards a target alone its trajectory and which can be guided in the trajectory, comprising:

a main part and a rear part;

stabilizing fins (3, 32) arranged at a rear end of the missile for stabilizing the missile; and control elements (6, 7) which are arranged at a front end of the missile and are arranged to guide the missile, wherein the rear part of the missile comprises a body part (4, 31) which can rotate freely relative to the main part (1, 29) of the missile about a bearing (14, 36) arranged concentric to the longitudinal axis (L) of the missile (1), the stabilizing fins are secured to the rear part of the missile, the bearing (14, 36) is arranged near a dividing plane between the body part (4, 31) and a remainder of the missile (1) and has a large diameter compared with its length in the longitudinal direction of the missile, the bearing is designed with a slight axial clearance, both forwards and rearwards of the bearing, in the main part of the missile and in said body part there are peripheral annular contact surfaces (20, 21 and 27, 28) which in pairs are brought to bear against each other immediately before said axial clearance reaches its respective end positions in the bearing in order to transfer forces acting between the main part (1, 29) of the missile and said body part (4, 31) or parts thereof, contact surfaces (20, 21) which limit the removal of the main part (1) of the missile and the body part (4) from each other are frustoconical in shape, and contact surfaces (27, 28) which limit the pressing-together of the two parts are flat and annular.

2. Fin-stabilized missile according to claim 1, wherein a first body section (35) is rotatably mounted via the bearing (36) in a second special front body section (34) which does not rotate relative to the rest of the missile, and after the missile has left a launch arrangement the body sections (35, 36) can be displaced together from a first starting position, where both the body sections are situated inside a space (30) in the rear part of the missile, to a second trajectory position where the first body section (35) is situated completely behind the original rear plane of the missile, while the second front body section (34) is locked relative to the rest of the missile near the original rear plane.

3. Fin-stabilized missile (1) according to claim 1, comprising:

a component (8, 34–35) which can be displaced relative to the rest of the missile wherein after die missile (1) has left the barrel of a launch arrangement, the component is displaced axially from a first position to a second position, and;

a chamber (40, 38) which is arranged between said component and an inner base plane and to which there leads an inlet channel (13, 39) with a limited cross-sectional area, through which the chamber (40, 38) during launch inside a barrel is supplied with propellant powder gases under high pressure which, when the pressure outside the chamber drops as soon as the missile has left the barrel, will effect the desired displacement of the component.

4. Fin-stabilized missile according to claim 1, wherein the pairs of mutually interacting contact surfaces which limit the movements of the parts (1, 4 and 34, 35) relative to each other are arranged at different axial distances from the bearing and also partially overlap each other in the radial direction.

5. Fin-stabilized missile according to claim 1, wherein the bearing (14, 36) comprises a ball bearing (14, 36) with an outer ring (15) clamped securely in the main part (1, 29) of the missile and an inner ring (16) connected to the body part via an attachment, which gives a limited mobility in the axial direction forwards and rearwards in the flight direction of the missile (1), and movement of the main part (1, 29) of the missile and the body part away from each other is counteracted by a spring arrangement (22) clamped between the body part (4) and the inner ring (16) of the ball bearing (14).

6. Fin-stabilized missile according to claim 1, wherein the axial clearance in the pressing direction between the peripheral annular contact surfaces (27, 28) does not exceed the axial play of the ball bearing.

7. Fin-stabilized missile (1) which is intended to be fired at high acceleration towards a target alone its trajectory and which can be guided in the trajectory, comprising:

a main part and a rear part;

stabilizing fins (3, 32) arranged at a rear end of the missile for stabilizing the missile; and control elements (6, 7) which are arranged at a front end of the missile and are arranged to guide the missile, wherein the rear part of the missile comprises a body part (4, 31) which can rotate freely relative to the main part (1, 29) of the missile about a bearing (14, 36) arranged concentric to the longitudinal axis (L) of the missile (1), the stabilizing fins are secured to the rear part of the missile, the bearing (14, 36) is arranged near a dividing plane between the body part (4, 31) and a remainder of the missile (1) and has a large diameter compared with its length in the longitudinal direction of the missile, the bearing is designed with a slight axial clearance, both forwards and rearwards of the bearing, in the main part of the missile and in said body part there are peripheral annular contact surfaces (20, 21 and 27, 28) which in pairs are brought to bear against each other immediately before said axial clearance reaches its respective end positions in the bearing in order to transfer forces acting between the main part (1, 29) of the missile and said body part (4, 31) or parts thereof, and the pairs of mutually interacting contact surfaces which limit the movements of the parts (1, 4 and 34, 35) relative to each other are arranged at different axial distances from the bearing and else partially overlap each other in the radial direction.

8. Fin-stabilized missile according to claim 7, wherein the bearing (14, 36) comprises a ball bearing (14, 36) with an outer ring (15) is clamped securely in the main part (1, 29) of the missile and an inner ring (16) connected to the body part via an attachment, which gives a limited mobility in the axial direction forwards and rearwards in the flight direction of the missile (1), and movement of the main part (1, 29) of the missile and the body part away from each other is counteracted by a spring arrangement (22) clamped between the body part (4) and the inner ring (16) of the ball bearing (14).

9. Fin-stabilized missile according to claim 7, wherein the axial clearance in the pressing direction between the peripheral annular contact surfaces (27, 28) does not exceed the axial play of the ball bearing.

10. Fin-stabilized missile according to claim 7, wherein a first body section (35) is rotatably mounted via the bearing (36) in a second special front body section (34) which does not rotate relative to the rest of the missile, and slier the missile has left a launch arrangement the body sections (35, 36) can be displaced together from a first starting position, where both the body sections are situated inside a space (30) in the rear part of the missile, to a second trajectory position where the first body section (35) is situated completely behind the original rear plane of the missile, while the second front body section (34) is locked relative to the rest of the missile near the original rear plane.

11. Fin-stabilized missile (1) according to claim 7, comprising:

a component (8, 34–35) which can be displaced relative to the rest of the missile, wherein after the missile (1) has left the barrel of a launch arrangement, the component is displaced axially from a first position to a second position and;

a chamber (40, 38) which is arranged between said component and an inner base plane and to which there leads an inlet channel (13, 39) with a limited cross-sectional area, through which the chamber (40, 38) during launch inside a barrel is supplied with propellant powder gases under high pressure which, when the pressure outside the chamber drops as soon as the missile has left the barrel, will effect the desired displacement of the component.

12. Fin-stabilized missile (1) which is intended to be fired at high acceleration towards a target alone its trajectory and which can be guided in the trajectory, comprising:

a main part and a rear part;

stabilizing fins (3, 32) arranged at a rear end of the missile for stabilizing the missile;

control elements (6, 7) which are arranged at a front end of the missile and are arranged to guide the missile; wherein the rear part of the missile comprises a body part (4, 31) which can rotate freely relative to the main part (1, 29) of the missile about a bearing (14, 36) arranged concentric to the longitudinal axis (L) of the missile (1), the stabilizing fins are secured to the rear part of the missile, the bearing (14, 36) is arranged near a dividing plane between the body part (4, 31) and a remainder of the missile (1) and has a large diameter compared with its length in the longitudinal direction of the missile, the bearing is designed with a slight axial clearance, both forwards and rearwards of the bearing, in the main part of the missile and in said body part there are peripheral annular contact surfaces (20, 21 and 27, 28) which in pairs are brought to bear against each other immediately before said axial clearance reaches its respective end positions in the bearing in order to transfer forces acting between the main part (1, 29) of the missile and said body part (4, 31) or parts thereof, the bearing (14, 36) comprises a ball hearing (14, 36) with an outer ring (15) clamped securely in the main part (1, 29) of the missile and whose in inner ring (16) connected to the body part via an attachment, which gives a limited mobility in the axial direction forwards and rearwards in the flight direction of the missile (1), and movement of the main part (1, 29) of the missile and die body part away from each other is counteracted by a spring arrangement (22) clamped between the body part (4) and the inner ring (16) of the ball bearing (14).

13. Fin-stabilized missile (1) according to claim 12, wherein said spring arrangement (22) is designed to accept a certain loading of missile and body part away from each other and associated displacement between them before the contact surfaces (20, 21) acting in this direction bear against each other, where said ball bearing (14) is at the same time adapted to take up forces acting between the outer ring (15) and inner sing (16).

14. Fin-stabilized missile according to claim 13, wherein the inner ring (16) of the same ball bearing is arranged on a bearing support (17) securely connected to said body part and, when the main part of the missile (1) and the body part (4) are loaded in the direction away from each other, it displaces counter to said spring arrangement (22) within certain predetermined limits within which the ball bearing (14) gives the desired free rotation for the body part (4) relative to the main part of the missile (1).

15. Fin-stabilized missile according to claim 13, wherein said spring arrangement (22) consists of an annular spring of L-shaped cross section with a first lamb (23) which extends rearwards in the direction of flight of the missile and which is secured to the body part (4), and a second resilient limb (26) which extends radially in towards the center of the bearing and lies against the edge of the inner ring (16) of the ball bearing which is directed forwards in the direction of flight of the missile.

16. Fin-stabilized missile according to claim 12, wherein the inner ring (16) of the ball bearing is arranged on a bearing support (17) securely connected to said body part and, when the main part of the missile (1) and the body part (4) are loaded in the direction away from each other, it displaces counter to said spring arrangement (22) within certain predetermined limits within which the ball bearing (14) gives the desired free rotation for the body part (4) relative to the main part of the missile (1).

17. Fin-stabilized missile according to claim 16, wherein said spring arrangement (22) comprises an annular spring of L-shaped cross section with a first limb (23) which extends rearwards in the direction of flight of the missile and which is secured to the body part (4), and a second resilient limb (26) which extends radially in towards the center of the bearing and lies against the edge of the inner ring (16) of the ball bearing which is directed forwards in the direction of flight of the missile.

18. Fin-stabilized missile according to claim 12, wherein the axial clearance in the pressing direction between the peripheral annular contact surfaces (27, 28) does not exceed the axial play of the ball bearing.

19. Fin-stabilized missile according to claim 12, wherein said spring arrangement (22) comprises an annular spring of L-shaped cross section with a first limb (23) which extends rearwards in the direction of flight of the missile and which is secured to the body part (4), and a second resilient limb (26) which extends radially in towards the center of the bearing and lies against the edge of the inner ring (16) of the ball bearing which is directed forward in the direction of flight of the missile.

20. Fin-stabilized missile according to claim 12, wherein a first body section (35) is rotatably mounted via the bearing (36) in a second special front body section (34) which does not rotate relative to the rest of the missile, and after the missile has left a launch arrangement the body sections (35, 36) can be displaced together from a first starting position, where both the body sections are situated inside a space (30) in the rear part of the missile, to a second trajectory position where the first body section (35) is situated completely behind the original rear plane of the missile, while the second front body section (34) is locked relative to the rest of the missile near the original rear plane.

* * * * *